US009130291B2

(12) United States Patent
Poh et al.

(10) Patent No.: US 9,130,291 B2
(45) Date of Patent: Sep. 8, 2015

(54) DEVICE CONNECTOR INCLUDING MAGNET

(75) Inventors: Kian Teck Poh, Singapore (SG); Chee How Lee, Singapore (SG); Jing Kai Tan, Singapore (SG)

(73) Assignee: HEWLETT-PACKARD DEVELOPMENT COMPANY, LP., Houston, TX (US)

( * ) Notice: Subject to any disclaimer, the term of this patent is extended or adjusted under 35 U.S.C. 154(b) by 301 days.

(21) Appl. No.: 13/598,123

(22) Filed: Aug. 29, 2012

(65) Prior Publication Data

US 2014/0065846 A1 Mar. 6, 2014

(51) Int. Cl.
*H01R 11/30* (2006.01)
*H01R 13/62* (2006.01)

(52) U.S. Cl.
CPC ..... *H01R 11/30* (2013.01); *H01R 13/6205* (2013.01)

(58) Field of Classification Search
CPC .... H01R 13/6205; H01R 11/30; H01R 12/79; H01R 12/91; H01R 43/20; H01R 13/53; H01R 13/64; H01R 13/2421; H01R 31/06; H01R 13/7037; H01F 38/14
USPC ..... 439/38–40
See application file for complete search history.

(56) References Cited

U.S. PATENT DOCUMENTS

| | | | | |
|---|---|---|---|---|
| 6,561,815 | B1 * | 5/2003 | Schmidt | 439/38 |
| 7,498,546 | B2 | 3/2009 | Belongia et al. | |
| 7,645,143 | B2 | 1/2010 | Rohrbach et al. | |
| 7,722,358 | B2 | 5/2010 | Chatterjee et al. | |
| 8,497,753 | B2 * | 7/2013 | DiFonzo et al. | 335/205 |
| 2005/0255718 | A1 * | 11/2005 | McLeish | 439/39 |
| 2014/0162468 | A1 * | 6/2014 | Kim | 439/39 |

FOREIGN PATENT DOCUMENTS

| | | | | |
|---|---|---|---|---|
| KR | 2002080766 A | * | 10/2002 | H01R 11/30 |
| WO | WO-2007127869 | | 11/2007 | |

OTHER PUBLICATIONS

BlackBerry Rapid Wall Charger for PlayBook, http://shop.crackberry.com/blackberry-rapid-wall-charger/5A17A8107.htm.

* cited by examiner

*Primary Examiner* — Briggitte R Hammond
(74) *Attorney, Agent, or Firm* — Hewlett-Packard Patent Department

(57) ABSTRACT

In one implementation a device connector includes a first electronic device magnet, second electronic device magnet, and third electronic device magnet to connect to a power supply. The power supply magnet can be oriented to the opposite pole of one of the electronic device magnets.

19 Claims, 9 Drawing Sheets

| Power Supply Type | Mag 1 | Mag 2 | Mag 3 |
|---|---|---|---|
| 1 | N | N | N |
| 2 | N | N | S |
| 3 | N | S | S |
| 4 | N | S | N |
| 5 | S | N | N |
| 6 | S | N | S |
| 7 | S | S | S |
| 8 | S | S | N |

FIG 3

| Power Supply Wattage | Mag 1 | Mag 2 | Mag 3 |
|---|---|---|---|
| 45 | S | | |
| 60 | | S | |
| 90 | | | S |
| x | S | S | |
| x | | S | S |
| x | S | | S |
| x | S | S | S |

FIG 4

| Electronic Device Wattage | Mag 1 | Mag 2 | Mag 3 |
|---|---|---|---|
| 45 | N | N | N |
| 60 | S | N | N |
| 90 | S | S | N |

FIG 5

DEVICE CONNECTOR INCLUDING MAGNET

BACKGROUND

Portable electronic devices, such as computers, music players, phones or other electronic devices may receive power from an external power supply. Not all power supplies are compatible with every electronic device. A portable electronic device can have a power draw, for example the power draw of a notebook computer maybe, such as 60 watts. A power supply should be able to supply at least the maximum power draw of the portable electronic device or the portable electronic device may not operate or may have to disable some features.

BRIEF DESCRIPTION OF THE DRAWINGS

Some embodiments of the invention are described with respect to the following figures:

FIG. 3 is a table representing the example combinations of magnets according to an example implementation;

FIG. 4 is a table representing the example combinations of magnets in a power supply according to an example implementation;

FIG. 5 is a table representing the example combinations of magnets in an electrical device according to an example implementation;

DETAILED DESCRIPTION

Figure 1A:
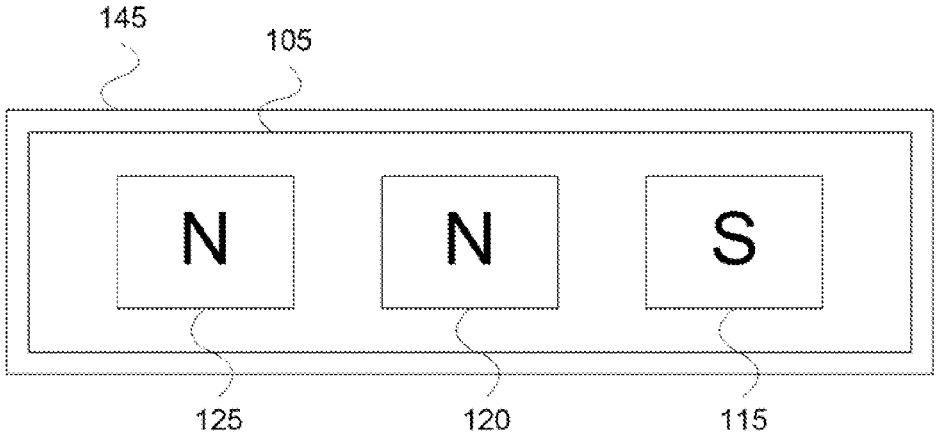
FIG. 1*a* is a block diagram of an electronic device according to an example implementation.

To make a portable electronic device as small as possible the power adapter may be external to the portable electronic device. A power supply that is external to the portable electronic device may be connected to the portable electronic device through a device connector. A power supply may be damaged, lost or a second power supply may be desired to use at another location such as in a vehicle.

A manufacturer may want to make sure power supplies that connect to a different electronic devices are compatible, however to power the larger devices the power supply may have to be physically larger and heavier than the power supply for a smaller device. For example the power supply for a notebook computer may be larger than the power supply for a phone. Using the same connectors for all the devices made by a manufacturer may save manufacture costs however a user may not understand the difference between the different types or ratings of a power supply and which one works properly with the electronic device.

A device connector may include a binary code that is created by magnets and the power supply connector may have a complementary binary code created by a magnet so that the magnets attract a connector of a power supply that can fully power the electronic device without having to turn off features and repels power supply connectors that would conflict with the device operation. For example if the electronic device is a network appliance the power supply may include power over Ethernet (POE) or the power supply may not include power over Ethernet. A POE power supply is not compatible with a non-POE power supply and using the wrong one in a network appliance can cause damage to the network appliance, the power supply or both.

A magnet may represent a binary code by using the poles of the magnet. For example the N (north) pole of a magnet may represent a 1 and the S (south) pole of a magnet may represent a 0. Therefore the more magnets that are included in the device connector the more combinations are available, the number of combinations are determined by 2^n, where n is the number of magnetic poles on the exterior surface of the connector.

In one implementation, an electronic system includes an electronic device. The electronic device includes a device connector. The device connector can include a first electronic device magnet, second electronic device magnet, and third electronic device magnet to connect to a power supply including a power supply connector to connect to the device connector by attracting a first power supply magnet in the power supply connector. The power supply magnet can be oriented to the opposite pole of one of the electronic device magnets.

Another implementation can be a method to couple a power supply to an electronic device. The method can include attracting, with a first, second or third magnet on the device connector of the electronic device, magnets with the opposite pole and repelling, with a magnet on the electronic device, magnets with the same pole. Power is received from a contact on the electronic device if the magnet has attracted a second magnet on a power supply connector with the opposite pole.

In another implementation, an electronic system includes an electronic device including a device connector. A first electronic device magnet with a first pole oriented toward the exterior of the electronic device is in the device connector. A power supply can include a power supply connector to connect to the device connector. A first power supply magnet oriented with the opposite pole of the first electronic device magnet if the power supply rating is compatible with the electronic device and oriented with the same pole of the first electronic device magnet if the power supply rating is not compatible with the electronic device.

With reference to the figures, FIG. 1*a* is a block diagram of an electronic device according to an example implementation. An electronic device 145 can include a device connector 105. The device connector 105 may be a port to receive power. The power can be supplied to the device connector from a power supply. The power received from the power supply can power the components of the electronic device 145, such as a processor, display or charge a battery. The device connector 105 can include a first electronic device magnet 115, second electronic device magnet 120, and third electronic device magnet 125. The first electronic device magnet 115, second electronic device magnet 120, and third electronic device magnet 125, can either attract a power supply connector or repel a power supply connector. For example, the first electronic device magnet 115 is shown with a S (south) pole and would attract an N (north) pole magnet and repel another S pole magnet. The second and third electronic device magnets are shown with N poles but any of the magnets could be oriented to create a binary key where there are 2^n combinations where n is the number of magnets. The first, second, or third power supply magnets 115, 120, 125 can connect to a power supply including a power supply connector by attracting a first power supply magnet in the power supply connector, when the power supply magnet is oriented to the opposite pole of one of the first electronic device magnet 115, second electronic device magnets 120, and third electronic device magnet 125.

Figure 1B:
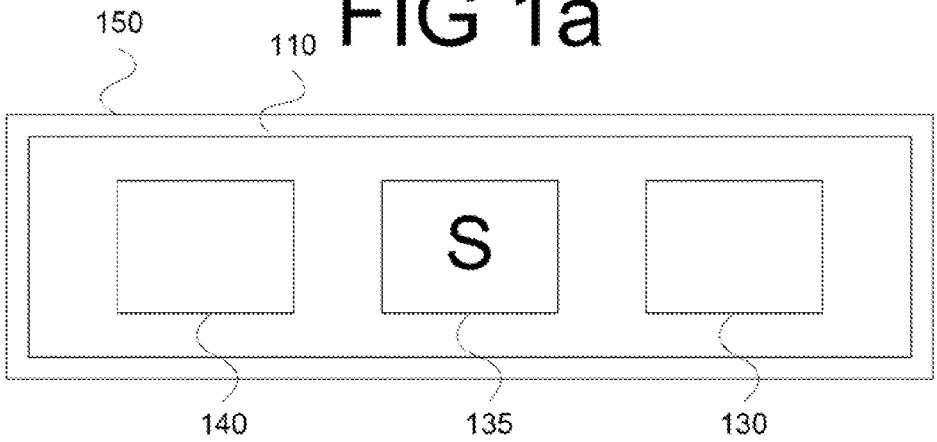
FIG. 1*b* is a block diagram of a power supply according to an example implementation.

FIG. 1*b* is a block diagram of a power supply 150 according to an example implementation. The power supply 150 includes a power supply connector 110. The power supply connector 110 can include multiple mounting locations for magnets such as, first mounting location 130, second mounting location 135, and third mounting location 140. In the example of FIG. 1*b* the first mounting location 130 and the third mounting location 140 do not have magnets and the second mounting location 135 includes a magnet oriented to the S pole. A magnet can be mounted in any of the mounting locations and can have either the N or the S pole on the exterior surface. A magnet does not have to be in every mounting location one magnet may be able to attract the power supply connector and also one magnet may repel the power supply connector from the device connector, therefore the other mounting locations may be empty or may have magnets. In one example if more than one mounting location has a magnet the magnets have to attract and if one magnet repels the power supply connector does not connect to the device connector.

The first, second and third mounting locations in the power supply connector may align with the first electronic device magnet, second electronic device magnet and the third electronic device magnet. For example if the electronic device magnets are in the same plane or are arranged linear then the mounting locations in the power supply connector may also be arranged in mirror image so that the first mounting location in the power supply connector is adjacent to the first electronic device magnet when the power supply connector is attached to the device connector.

Figure 1C:
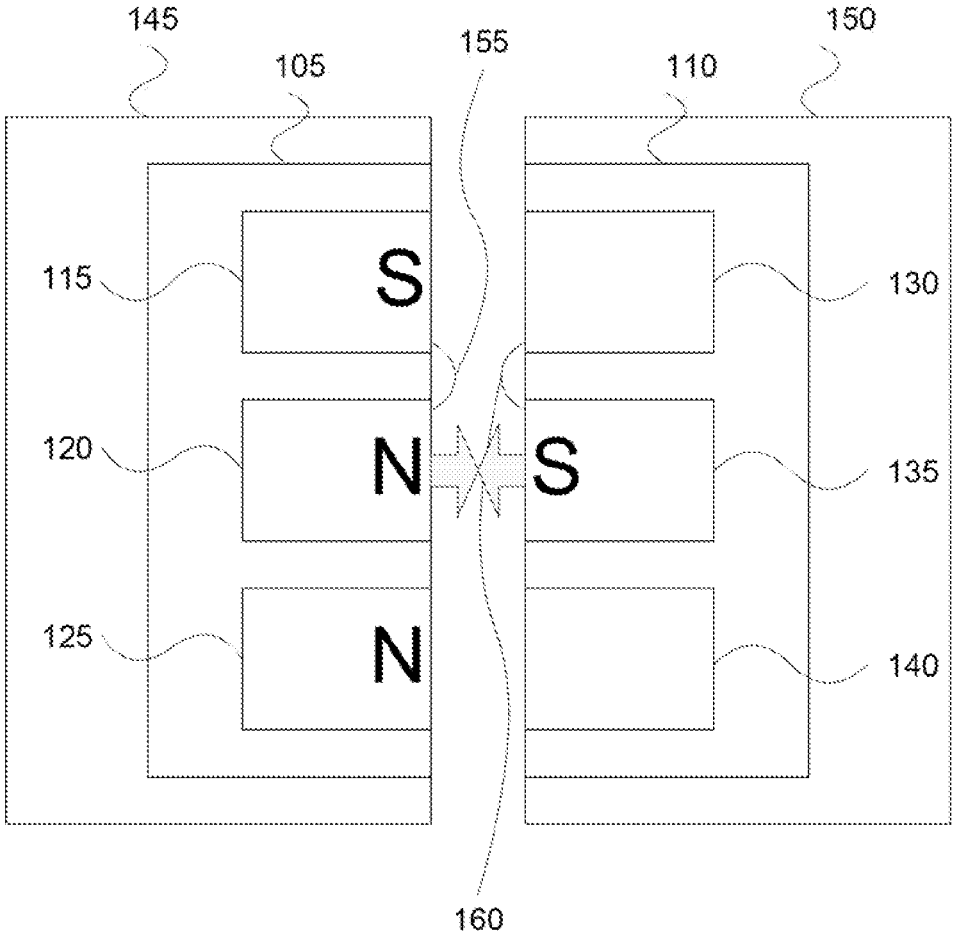
FIG. 1*c* is a block diagram of an electronic device and a power supply according to an example implementation.

FIG. 1*c* is a block diagram of an electronic device and a power supply according to an example implementation. The electronic device 145 includes device connector 105. Device connector 105 includes first electronic device magnet 115, second electronic device magnet 120, and third electronic device magnet 125. The power supply 150 includes a power supply connector 110. The power supply connector 110 can include multiple mounting locations for magnets such as first mounting location 130, second mounting location 135 and third mounting location 140. The first mounting location 130 and the third mounting location 140 do not have magnets and the second mounting location 135 includes a magnet oriented to the S pole. The second electronic device magnet 120 and the power supply magnet 135 are attracted together since they have opposite poles.

In one implementation, the first, second, third electronic device magnet or any combination thereof may conduct an electrical signal between the electronic device and the power supply. For example, the power supply may supply a negative DC (direct current) potential connection to the magnet in mounting location 135 and when the magnet 135 in the power supply connector 110 is connected to the second electronic device magnet 120 the current can pass between the power supply and the electronic device through a path that includes the power supply magnet and the electronic device magnet.

The device connector 105 may include an electronic device electrical contact 155 to receive power from the power supply. The electronic device electrical contact 155 may be a pogo pin or another type of electrical connection and may be made of any electrical conductive material such as copper, gold, silver or another material. The electronic device electrical contact 155 may electrically connect to the power supply electrical contact 160.

The first electronic device magnet 115, second electronic device magnet 120, and third electronic device magnet 125 can be on the outer surface of the electronic device 145 or the device connector 105. The outer surface means that the magnetic material is exposed or that the magnets are attached to the outer surface either internally or externally.

The force of attraction of a magnet may be determined by the size of the magnet, or the material the magnet is made of. The force of first electronic device magnet 115, second electronic device magnet 120, may be substantially similar or may be different in some implementation. For example the first magnet may attract at twice the force of the second magnet and therefore overcome the repulsion of the second magnet.

Figure 1D:
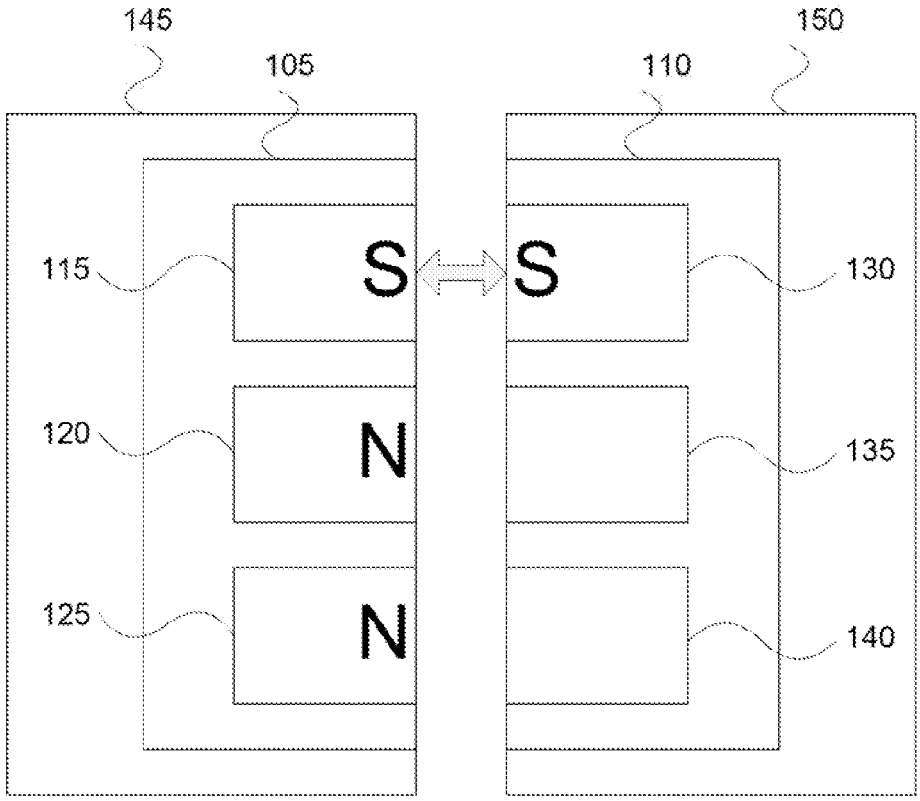
FIG. 1*d* is a block diagram of an electronic device and a power supply according to an example implementation.

FIG. 1*d* is a block diagram of an electronic device and a power supply according to an example implementation. The electronic device 145 includes device connector 105. Device connector 105 includes first electronic device magnet 115, second electronic device magnet 120, and third electronic device magnet 125. The power supply 150 includes a power supply connector 110. The power supply connector 110 can include multiple mounting locations for magnets such as first mounting location 130, second mounting location 135 and third mounting location 140. The second mounting location 135 and the third mounting location 140 do not have magnets and the first mounting location 130 includes a magnet oriented to the S pole. The first electronic device magnet 115 and the power supply magnet at mounting location 130 are repelled since they have the same poles, S and S. Therefore the position and the pole of the magnet can determine whether the power supply connector is attracted to or repelled by the device connector.

Figure 2A:
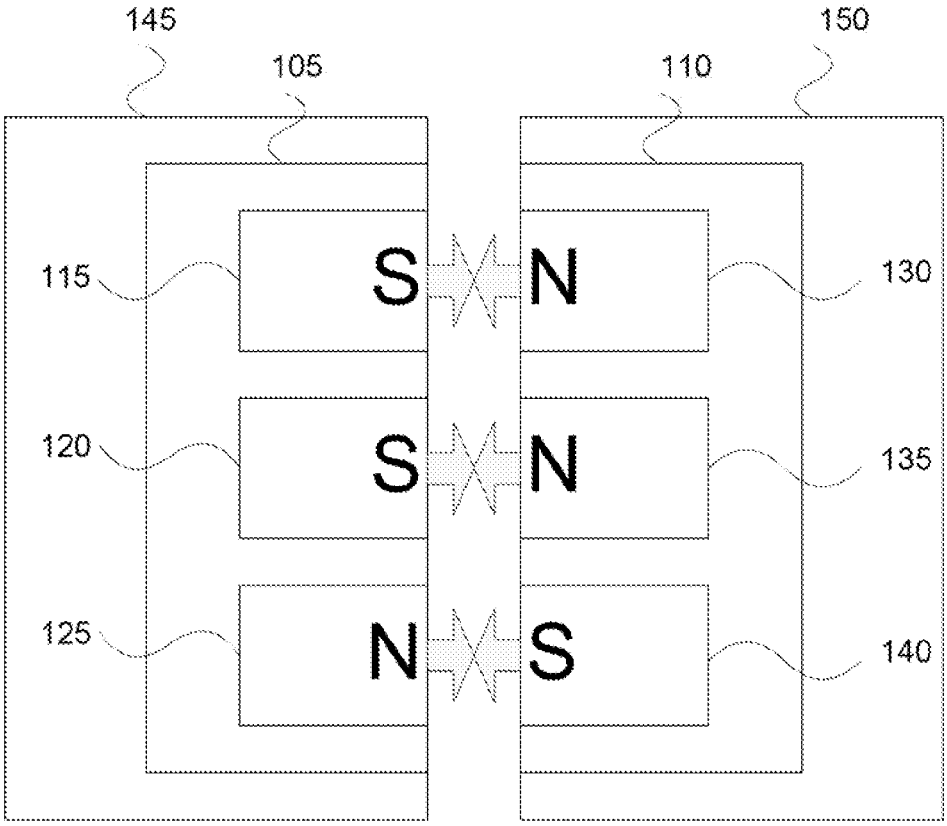
FIG. 2*a* is a block diagram of an electronic device and a power supply according to an example implementation.

FIG. 2*a* is a block diagram of an electronic device and a power supply according to an example implementation. The electronic device 145 includes device connector 105. Device connector 105 includes first electronic device magnet 115, second electronic device magnet 120, and third electronic device magnet 125. The power supply 150 includes a power supply connector 110. The power supply connector 110 can include multiple mounting locations for magnets such as first mounting location 130, second mounting location 135 and third mounting location 140. The first mounting location 130, second mounting location 135 and third mounting location 140 include a first power supply magnet, a second power supply magnet and a third power supply a magnet respectively. The first power supply magnet, the second power supply magnet and the third power supply magnet of the example of FIG. 2*a* are attracted to the first electronic device magnet 115, second electronic device magnet 120, and third electronic device magnet 125.

Figure 2B:
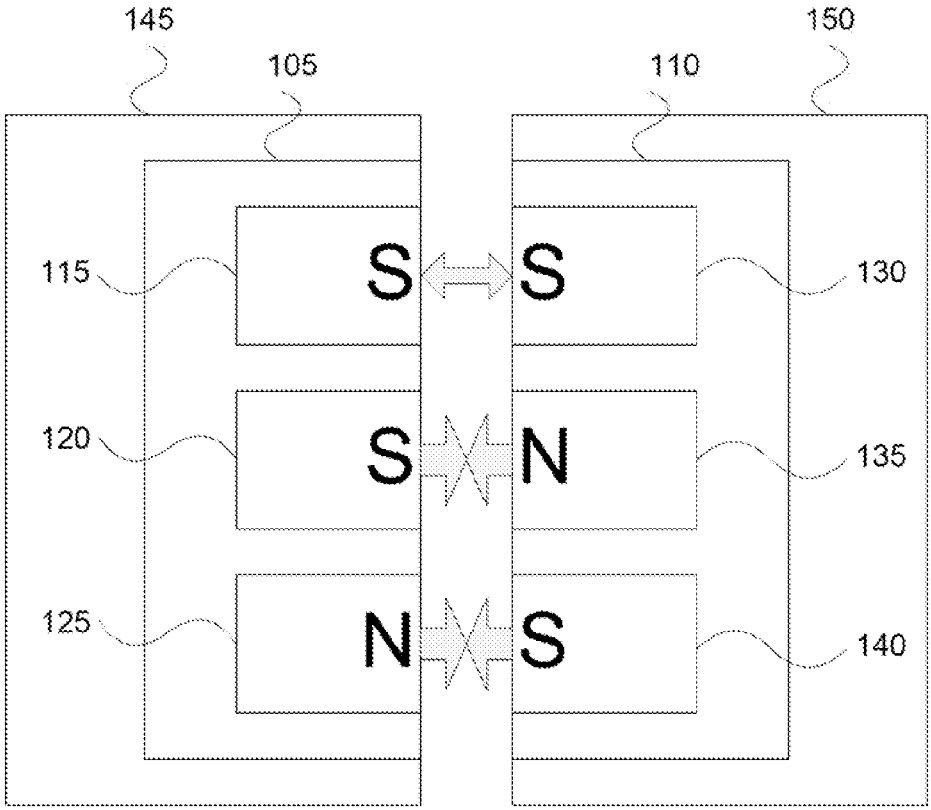
FIG. 2*b* is a block diagram of an electronic device and a power supply according to an example implementation.

FIG. 2*b* is a block diagram of an electronic device and a power supply according to an example implementation. The electronic device 145 includes device connector 105. Device connector 105 includes first electronic device magnet 115, second electronic device magnet 120, and third electronic device magnet 125. The power supply 150 includes a power supply connector 110. The power supply connector 110 can include multiple mounting locations for magnets such as first mounting location 130, second mounting location 135 and third mounting location 140. The first mounting location 130, second mounting location 135 and third mounting location 140 include a first power supply magnet, a second power supply magnet and a third power supply a magnet respectively. The second power supply magnet and the third power supply magnet of the example of FIG. 2*b* are attracted to the second electronic device magnet 120, and third electronic device magnet 125. The first electronic device magnet is repelled by the first power supply magnet in the first mounting location 130.

FIG. 3 is a table representing the example combinations of magnets according to an example implementation. If three magnets are used there are 8 possible combinations. The power supply type may indicate that the power supply is for a network device, a portable computer, a printer or another type of electronic device. The power supply type may also indicate whether the power supply is a POE or non-POE power supply. The power supply type may indicate the power supply rating.

FIG. 4 is a table representing the example combinations of magnets in a power supply according to an example implementation. For a 45 watt power supply the first mounting location can include a magnet with an S pole and the second and third mounting locations may not include a magnet. For a 60 watt power supply the second mounting location can include a magnet with an S pole and the first and third mounting locations may not include a magnet, for a 90 watt power supply the third mounting location can have an S pole and the second and third mounting locations may not include a magnet. The other combinations of magnets may or may not be used depending on the application.

FIG. 5 is a table representing example combinations of magnets in an electrical device according to an example implementation. The electronic device may have a power draw that allows the electronic device to be fully operational. The Electronic device may have a power draw of 45 watts, 60 watts or 90 watts for example. The 45 watt electronic device may include a first electronic device magnet with an N pole, a second electronic device magnet with an N pole and a third electronic device magnet with an N pole. The 60 watt electronic device may include a first electronic device magnet with an S pole, a second electronic device magnet with an N pole and a third electronic device magnet with an N pole. The 90 watt electronic device may include a first electronic device magnet with an S pole, a second electronic device magnet with an S pole and a third electronic device magnet with an N pole.

The 45 watt power supply (as shown in FIG. 4) has an S pole magnet in the first mounting location and would be attracted to the first electronic device magnet with an N pole of an electronic device drawing 45 watts but would be repelled by the first electronic device magnets with an S pole of the electronic devices drawing 60 or 90 watts.

The 60 watt power supply (as shown in FIG. 4 has an S pole magnet in the second mounting location and would be attracted to the second electronic device magnet with an N pole of an electronic device drawing 45 watts and an electronic device drawing 60 watts, but would be repelled by the first electronic device magnets with an S pole of the electronic device drawing 90 watts.

The 90 watt power supply (as shown in FIG. 4) has an S pole magnet in the third mounting location and would be attracted to the third electronic device magnet with an N pole of an electronic device drawing 45 watts, an electronic device drawing 60 watts, and of an electronic device drawing 90 watts.

In this example, a power supply connector of a power supply with a power rating at least as large as the power draw of the electronic device is attracted to the device connector of the electronic device and a power supply that does not meet the power draw of the electronic device is repelled. Additional magnets and different combinations may be used depending on the number of power supply types or of the different electronic device power draws.

Figure 6:
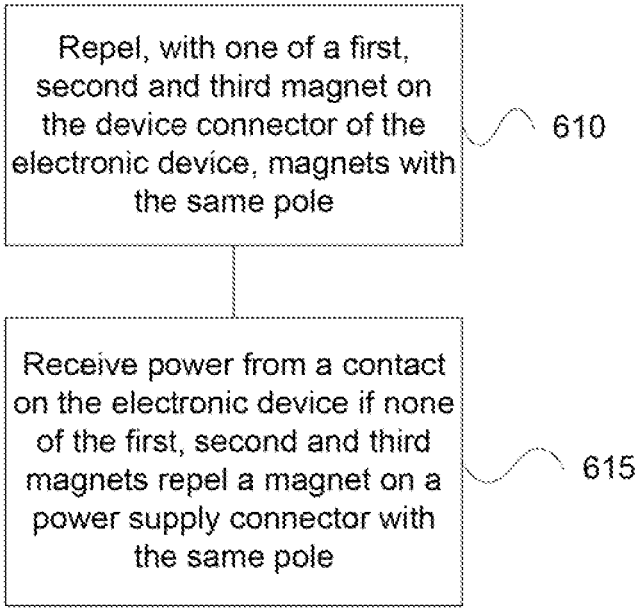
FIG. 6 is a flow chart of a method of connecting an electronic device to a power supply connector according to an example implementation.

FIG. 6 is a flow chart of a method of connecting an electronic device to a power supply connector according to an example implementation. The method of coupling a power supply to an electronic device includes one of a first, second and third magnet on the device connector of the electronic device to repel magnets with the same pole at 610. Power from a contact on the electronic device is received if none of the first, second and third magnets repel a magnet on a power supply connector with the same pole at 615.

Figure 7:
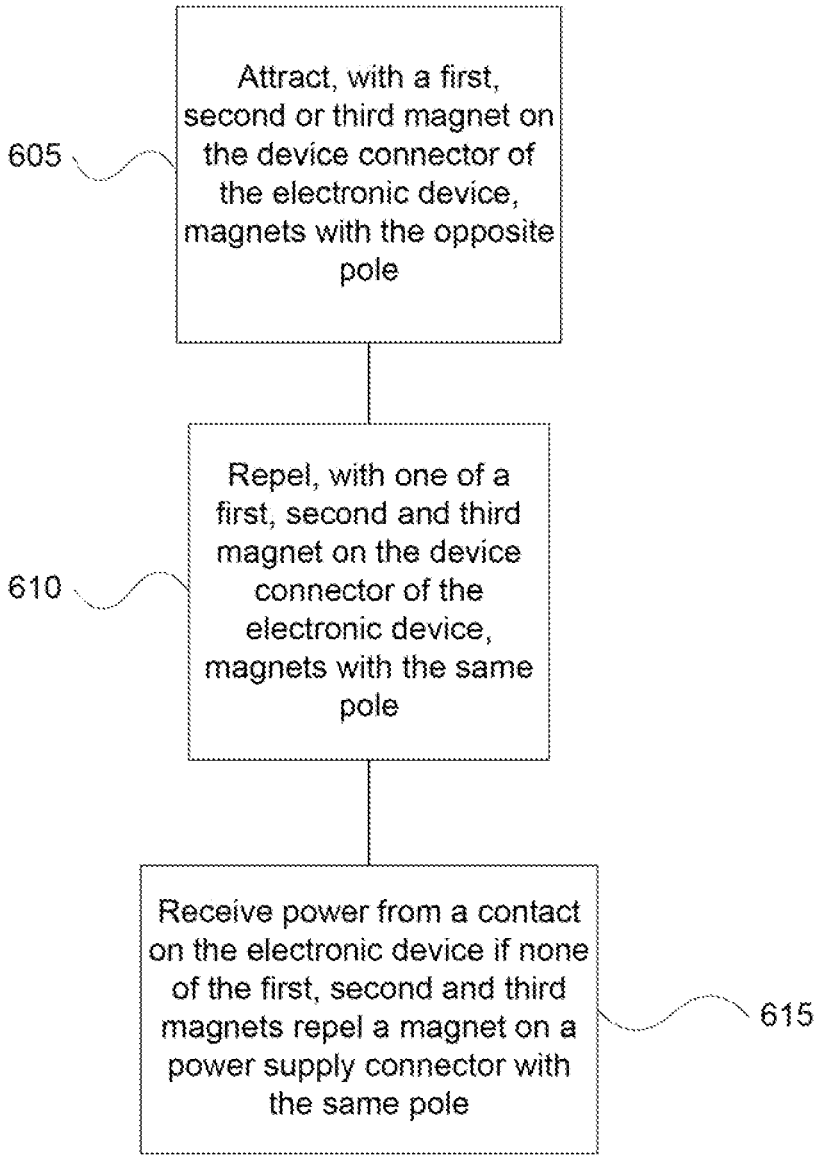
FIG. 7 is a flow chart of a method of connecting an electronic device to a power supply connector according to an example implementation.

FIG. 7 is a flow chart of a method of connecting an electronic device to a power supply connector according to an example implementation. The method of coupling a power supply to an electronic device includes one of a first, second and third magnet on the device connector of the electronic device to attract magnets with the opposite pole at 605.

One of a first, second and third magnet on the device connector of the electronic device to repel magnets with the same pole at 610. Power from a contact on the electronic device is received if none of the first, second and third magnets repel a magnet on a power supply connector with the same pole at 615.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. An electronic system comprising:

an electronic device including a device connector;

a first electronic device magnet, second electronic device magnet, and third electronic device magnet to connect the device connector to a power supply including a power supply connector by attracting one of the first electronic device magnet, the second electronic device magnet, or the third electronic device magnet by a power supply magnet in the power supply connector;

wherein the power supply magnet is oriented to the opposite pole of one of the first electronic device magnet, second electronic device magnets, and third electronic device magnet, wherein the orientation of the first, second and third electronic device magnets represents a power draw associated with the electronic device.

2. The system of claim 1, further comprising a first, second and third mounting location in the power supply connector, wherein the power supply magnet is in one of the first, second and third mounting locations.

3. The system of claim 2, wherein the first, second and third mounting locations in the power supply connector align with the first electronic device magnet, second electronic device magnet and the third electronic device magnet.

4. The system of claim 2, further comprising a second power supply magnet and a third power supply magnet.

5. The system of claim 1, wherein at least one of the first, second and third electronic device magnet conduct an electrical signal between the electronic device and the power supply.

6. The system of claim 1, wherein the first, second and third electronic device magnet are on an outer surface of the electronic device.

7. The system of claim 1, wherein the first second and third electronic device magnets are linear.

8. The system of claim 1, further comprising a second power supply magnet.

9. The system of claim 8, further comprising a third power supply magnet.

10. The system of claim 1, further comprising an electronic device electrical contact to receive power from the power supply.

11. The system of claim 1, further comprising a power supply electrical contact to supply power to the electronic device electrical contact.

12. The system of claim 1, wherein a force of the first and second electronic device magnets is different.

13. A method of coupling a power supply to an electronic device comprising:

coupling a power supply connector of a power supply to a device connector of an electronic device, the device connector having a first electronic device magnet, second electronic device magnet, and third electronic device magnet, the power supply connector having a power supply magnet; and receiving power from a contact on the electronic device if none of the first, second and third electronic device magnets repel the power supply magnet, wherein the orientation of the first, second and third electronic device magnets represents a power draw of the electronic device.

14. The method of claim 13, further comprising:

attracting, with one of the first, second or third electronic device magnet on the device connector of the electronic device, the power supply magnet.

15. An electronic system comprising:

an electronic device including a device connector, the device connector including two or more electronic device magnets, each electronic device magnet having a pole oriented toward the exterior of the electronic device, wherein at least one pole oriented toward the exterior of the electronic device is different from at least one other pole oriented toward the exterior of the electronic device;

a power supply including a power supply connector to connect to the device connector, wherein the power supply connector includes a first power supply magnet having a pole oriented to attract at least one electronic device magnet of the device connector if the power supply rating is compatible with the electronic device.

16. The system of claim 15, wherein the two or more electronic device magnets includes a first electronic device magnet, a second electronic device magnet and a third electronic device magnet.

17. The system of claim 15, wherein the power supply connector further comprises a second power supply magnet.

18. The system of claim 17, wherein the power supply connector further comprises a third power supply magnet.

19. The system of claim 15, wherein an orientation of the two or more electronic device magnets represents a power draw of the electronic device.

* * * * *